US008963678B2

(12) United States Patent
Feng et al.

(10) Patent No.: US 8,963,678 B2
(45) Date of Patent: Feb. 24, 2015

(54) CIRCUIT BREAKER CLOSING/OPENING ACTUATING MECHANISM AND DRIVING DEVICE THEREOF

(76) Inventors: Shuo Feng, Shanghai (CN); Yunfu Feng, Shanghai (CN)

( * ) Notice: Subject to any disclaimer, the term of this patent is extended or adjusted under 35 U.S.C. 154(b) by 106 days.

(21) Appl. No.: 13/578,243

(22) PCT Filed: Nov. 18, 2010

(86) PCT No.: PCT/CN2010/078848

§ 371 (c)(1),
(2), (4) Date: Aug. 9, 2012

(87) PCT Pub. No.: WO2011/097907

PCT Pub. Date: Aug. 18, 2011

(65) Prior Publication Data

US 2012/0306610 A1 Dec. 6, 2012

(30) Foreign Application Priority Data

Feb. 11, 2010 (CN) ..... 2010 1 0108869

(51) Int. Cl.

| | |
|---|---|
| ***H01H 37/36*** | (2006.01) |
| ***H01H 71/14*** | (2006.01) |
| *H01H 71/66* | (2006.01) |

(52) U.S. Cl.

CPC ..... *H01H 71/14* (2013.01); *H01H 2071/147* (2013.01); *H01H 2071/665* (2013.01)

USPC ..... 337/306

(58) Field of Classification Search

CPC ..... G01K 5/16; G01K 5/465; G05D 23/1921; H01H 29/30; H01H 35/242

USPC ..... 337/306, 315, 324, 393

See application file for complete search history.

(56) References Cited

U.S. PATENT DOCUMENTS

| | | | | |
|---|---|---|---|---|
| 2,542,889 | A * | 2/1951 | Baertl | 337/413 |
| 5,666,810 | A * | 9/1997 | Miesterfeld et al. | 60/530 |
| 5,738,658 | A * | 4/1998 | Maus et al. | 604/151 |
| 5,771,742 | A * | 6/1998 | Bokaie et al. | 74/2 |

* cited by examiner

*Primary Examiner* — Jenny L Wagner
*Assistant Examiner* — Michael P McFadden

(57) ABSTRACT

A circuit breaker closing/opening actuating mechanism and a driving device thereof, the driving device includes: an expansion body (12), and a heater (13), wherein the expansion body (12) is coupled to the force transmitting mechanism (11), when the heater (13) is powered on, the expansive matter (4) inside the shell (2) expands to motivate the force transmitting mechanism (11), so as to realize opening or closing a circuit breaker. The present invention has the following benefits of utilizing the expansion force and displacement generated by matter phase transforming when temperature changes to expand, for the circuit breaker to close or open, so as to realize remote controlling and automatic controlling of an electric switch. The present invention has simple structure, and acts reliably.

2 Claims, 2 Drawing Sheets

CIRCUIT BREAKER CLOSING/OPENING ACTUATING MECHANISM AND DRIVING DEVICE THEREOF

CROSS REFERENCE OF RELATED APPLICATION

This is a U.S. National Stage under 35 USC 371 of the International Application PCT/CN2010/078848, filed on Nov. 18, 2010.

BACKGROUND OF THE PRESENT INVENTION

1. Field of Invention

The present invention relates to the technology field of electric switches, and more particularly to a circuit breaker closing/opening actuating mechanism and a driving device thereof.

2. Description of Related Arts

At present, to switch on or off a circuit, circuit breakers are usually used. Their actuating mechanism of automatically closing and opening are mainly driven by motive powers such as motors and electromagnets, or even motivated with motors, decelerators, and connecting rods, which have complicated structure, so as to obtain the required power that the circuit breakers close and open. The conventional actuating mechanism has complicated structure, large volume, and high energy consumption when acting, and the corresponding controlling part also has high cost and complicated structure, so that its reliability is correspondingly reduced.

SUMMARY OF THE PRESENT INVENTION

An object of the present invention is to provide a circuit breaker closing/opening actuating mechanism and a driving device thereof for solving the drawbacks of the above prior art, which has extremely small volume, low energy consumption, easy operation, low cost, and simple structure, so as to be applied widely.

Accordingly, in order to accomplish the above object, the present invention provides a circuit breaker closing/opening actuating mechanism, comprising:

a driving device, and a force transmitting mechanism, wherein the force transmitting mechanism is coupled to a circuit breaker's switch mechanism, the driving device comprises an expansion body and a heater, the expansion body is coupled to the force transmitting mechanism, when the heater is powered on, an expansive matter in the expansion body expands when heated to produce volume-displacement change to motivate the force transmitting mechanism, the force transmitting mechanism drives the circuit breaker's switch mechanism to realize opening or closing a circuit breaker.

The volume change of the expansive matter in the expansion body is produced by phase transforming of solid phase-liquid phase or liquid phase-gas phase of the expansive matter.

The expansion body comprises a metal shell, the expansive matter positioned inside the metal shell, and a converter of volume expansion-displacement expansion.

The expansive matter is an organic or inorganic matter such as paraffin.

The heater adopts a positive temperature coefficient (PTC) thermistor or an electric heating element.

The force transmitting mechanism comprises an ejector rod, a spring and a soft wire.

A driving device of a circuit breaker closing/opening actuating mechanism, comprises:

a heater, a shell, an expansive matter positioned inside an inner sealed chamber of the shell, and a converter of volume expansion-displacement expansion, comprising an ejector rod piston, wherein the shell has an ejector rod through hole provided on a top surface thereof, the ejector rod piston is movably mounted inside the ejector rod through hole, the ejector rod piston is sealedly connected with the shell, a portion of the ejector rod piston positioned inside the inner sealed chamber of the shell is connected with the expansive matter directly or indirectly.

A fluid medium or the mixture of a fluid medium and the expansive matter is positioned inside the inner sealed chamber of the shell, the portion of the ejector rod piston positioned inside the inner sealed chamber of the shell is positioned in the fluid medium.

A separating membrane is positioned in the inner sealed chamber of the shell, and provided between the fluid medium and the expansive matter.

A sealing element is mounted between the ejector rod piston and the shell.

The sealing element is selected from the group consisting of a sealing O ring, a sealing pad, and an annular sealing sleeve.

The heater is positioned in the expansive matter inside the shell, or outside the shell contacting with the expansive matter.

The expansive matter is paraffin.

The heater adopts a positive temperature coefficient (PTC) thermistor or an electric heating element.

The working principle of the present invention is as follows. When a conducting wire is powered on, the heater heats the expansive matter inside the expansion body, so as to motivate the force transmitting mechanism, the force transmitting mechanism transmits a displacement and a force to the circuit breaker's switch mechanism (handle), so as to open or close the circuit breaker.

The present invention has the following benefits. The present invention utilizes the expansion force and displacement generated by phase transforming when temperature change, to provide power (force*displacement or torsion*angle) for the circuit breaker to close or open. The driving device is capable of driving an external coupled energy storage mechanism (i.e., force transmitting mechanism) or an original closing/opening mechanism of the circuit breaker to realizing opening or closing the circuit breaker when doing work. Combined with controlling circuit, the present invention is capable of realizing remote controlling and automatic controlling of an electric switch. In addition, the present invention has characteristics of simple structure, low controlling energy, acting reliably, and extremely small volume, but is capable of outputting extremely a large driving force, and has low cost. The driving device can be applied to miniature circuit breakers (MCB), moulded case circuit breakers (MCCB), frame type circuit breakers, vacuum circuit breakers and circuit breakers has closing/opening switches with contactor structure.

In the figures, 1—ejector rod piston, 2—shell, 3—sealing element, 4—expansive matter, 5—heater, 6—heater wire, 7—fluid medium, 8—membrane, 11—force transmitting mechanism, 12—expansion body, 13—heater, 14—conducting wire, and 15—circuit breaker's switch mechanism (handle).

DETAILED DESCRIPTION OF THE PREFERRED EMBODIMENT

These and other objectives, features, and advantages of the present invention will become apparent from the following detailed description, the accompanying drawings, and the appended claims.

Figure 1:
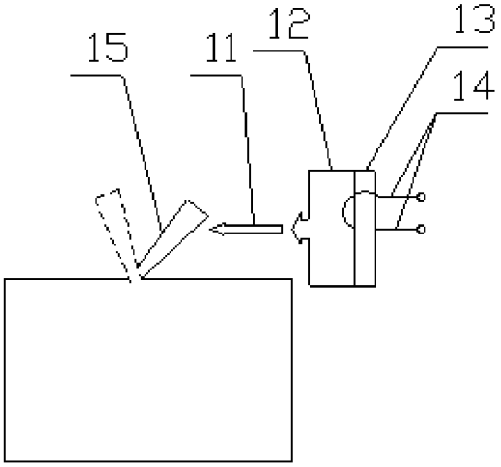
FIG. 1 is a sketch view of a circuit breaker closing/opening actuating mechanism according to a first preferred embodiment of the present invention.

Referring to FIG. 1 of the drawings, a circuit breaker closing/opening actuating mechanism according to a first preferred embodiment of the present invention is mounted outside a circuit breaker, comprising:

a force transmitting mechanism 11, an expansion body 12, a heater 13, a conducting wire 14, and a circuit breaker's switch mechanism (handle) 15, wherein the force transmitting mechanism 11 is coupled to the circuit breaker's switch mechanism 15, and comprises an ejector rod, a spring and a soft wire, the expansion body 12 is coupled to the force transmitting mechanism 11, the expansion body comprises a metal shell, an expansive matter positioned inside the metal shell, and a converter of volume expansion-displacement expansion, the expansion body 12 utilizes a volume change (expansion) produced by phase transforming of solid phase-liquid phase or liquid phase-gas phase of the expansive matter, and thermal expansion of liquid matter, metal or nonmetal matter to make the expansive matter produce phase transforming by heating methods of temperature coefficient (PTC) thermistors or other electric heating methods, so as to provide force*displacement or torsion*angle for closing or opening the electric switch.

Figure 2:
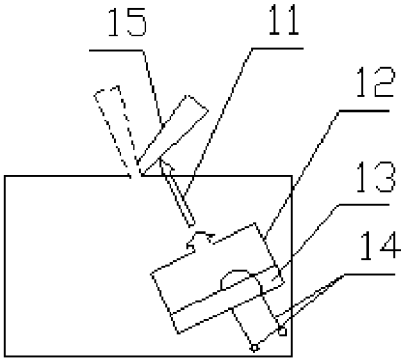
FIG. 2 is a sketch view of a circuit breaker closing/opening actuating mechanism according to a second preferred embodiment of the present invention.

Referring to FIG. 2 of the drawings, a circuit breaker closing/opening actuating mechanism according to a second preferred embodiment of the present invention is illustrated, differing from FIG. 1 by that the circuit breaker closing/opening actuating mechanism is mounted outside a circuit breaker.

Figure 3:
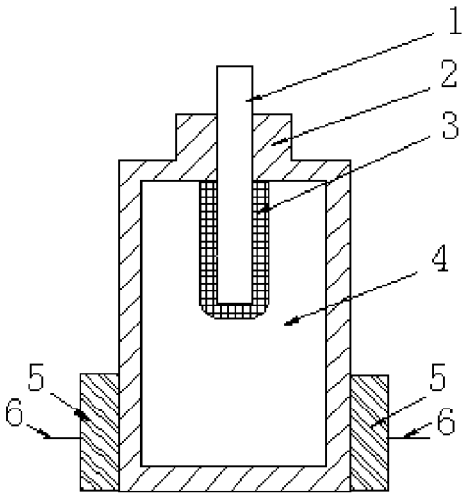
FIG. 3 is a sectional view of a driving device according to a first preferred embodiment of the present invention.

Referring to FIG. 3 of the drawings, a driving device of the circuit breaker closing/opening actuating mechanism according to a first preferred embodiment of the present invention is illustrated, comprising:

a heater 5, a shell 2, an expansive matter 4 positioned inside an inner sealed chamber of the shell 2, and a converter of volume expansion-displacement expansion, wherein the expansive matter 4 is paraffin, the heater 5 adopts a positive temperature coefficient (PTC) thermistor or an electric heating element. The converter of volume expansion-displacement expansion comprises an ejector rod piston 1, wherein the shell 2 has an ejector rod through hole on a top surface thereof, the ejector rod piston 1 is movably mounted inside the ejector rod through hole, a sealing element 3 is mounted between the ejector rod piston 1 and the shell 2, the sealing element 3 adopts an annular sealing sleeve, a portion of the ejector rod piston 1 positioned inside the inner sealed chamber of the shell 2 is positioned in the expansive matter 4 directly, the heater 5 is positioned inside the shell 2 contacting with the expansive matter 4.

Figure 4:
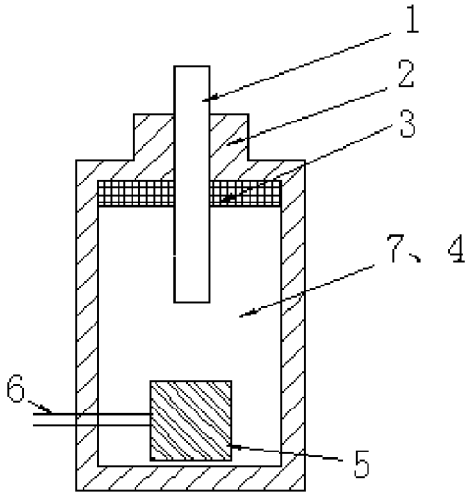
FIG. 4 is a sectional view of a driving device according to a second preferred embodiment of the present invention.

Referring to FIG. 4 of the drawings, a driving device of the circuit breaker closing/opening actuating mechanism according to a second preferred embodiment of the present invention is illustrated, differing from the first embodiment by that the sealing element 3 adopts a sealing O ring, a mixture of a fluid medium and the expansive matter 4 is positioned inside the inner sealed chamber of the shell 2, the portion of the ejector rod piston 1 positioned inside the inner sealed chamber of the shell 2 is positioned in the fluid medium, the fluid medium can adopt liquid lubrication oil, lubrication grease, sealing grease, or etc. The heater 5 is positioned in the expansive matter 4 inside the shell 2.

Figure 5:
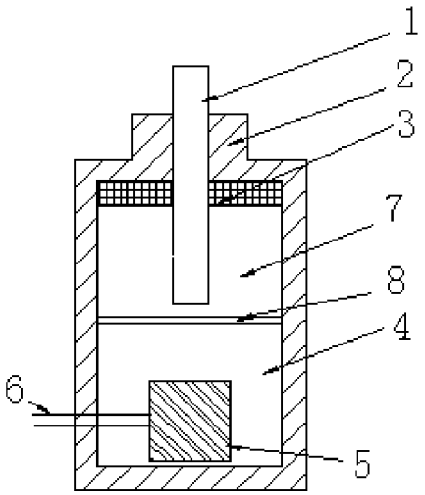
FIG. 5 is a sectional view of a driving device according to a third preferred embodiment of the present invention.

Referring to FIG. 5 of the drawings, a driving device of the circuit breaker closing/opening actuating mechanism according to a third preferred embodiment of the present invention is illustrated, which is improved based on the first embodiment by that a separating membrane 8 is added, the separating membrane 8 and provided between the fluid medium and the expansive matter 4 to separate the fluid medium from the expansive matter 4. The separating membrane 8 is made of a rubber material, a high polymer material, or a metal membrane. The separating membrane 8 is provided for the expansion force produced by the expansion material to motivate the ejector rod piston 1 more effectively. In addition, the fluid medium 7 is provided inside the inner sealed chamber of the shell 2 above the separating membrane 8, for converting the volume change of phase transforming of the expansive matter 4 into the force and displacement transmitted to the ejector rod piston 1.

Figure 6:
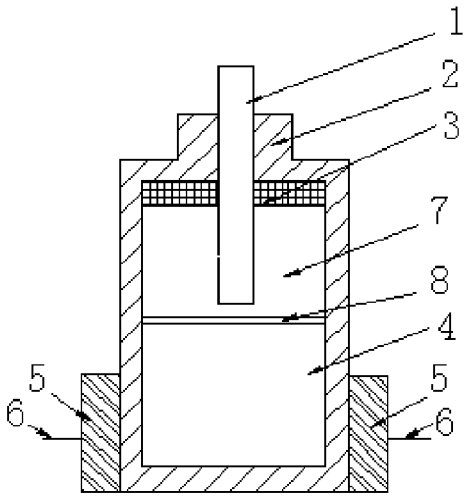
FIG. 6 is a sectional view of a driving device according to a fourth preferred embodiment of the present invention.

Referring to FIG. 6 of the drawings, a driving device of the circuit breaker closing/opening actuating mechanism according to a fourth preferred embodiment of the present invention is illustrated, differing from the third embodiment by that the heater 5 is positioned inside the shell 2 contacting with the expansive matter 4.

The driving device of the circuit breaker closing/opening actuating mechanism is mounted outside or inside the circuit breaker. When a heater wire 6 is powered on, the heater 5 heats the expansive matter 4 (or the mixture of the fluid medium and the expansive matter 4) inside the shell 2 up to a certain temperature to take solid-liquid phase transforming, and increase a volume thereof (i.e., expansion), the volume expansion is converted into displacement and force, and transmitted to the force transmitting mechanism 11 by the ejector rod piston 1 of proper size, the force transmitting mechanism 11 motivates the circuit breaker's switch mechanism (handle) 15 to realize closing or opening the circuit breaker.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A circuit breaker closing/opening actuating mechanism, comprising:

a driving device, and a force transmitting mechanism, wherein said force transmitting mechanism is coupled to a circuit breaker's switch mechanism, wherein said driving device comprises an expansion body and a heater, said expansion body is coupled to said force transmitting mechanism and has an expansive matter inside, said expansion body comprises a metal shell, said expansive matter positioned inside said metal shell, and a converter of volume expansion-displacement expansion, wherein said expansive matter is paraffin, said heater adopts a positive temperature coefficient (PTC) thermistor for preventing overheating or an electric heating element, said force transmitting mechanism comprises an ejector rod, a spring and a soft wire;

wherein said metal shell has an ejector rod through hole; said converter of said volume expansion-displacement expansion comprises an ejector rod piston which is movably mounted inside said ejector rod through hole; said ejector rod piston is sealedly connected with said metal shell; a portion of said ejector rod piston positioned inside said inner sealed chamber of said metal shell is connected with said expansive matter directly or indirectly; a mixture of a fluid medium and said expansive matter is positioned inside said inner sealed chamber of said metal shell; said portion of said ejector rod piston positioned inside said inner sealed chamber of said metal shell is positioned in said fluid medium; and a separating membrane is positioned in said inner sealed chamber of said metal shell, and provided between said fluid medium and said expansive matter;

wherein said volume expansion of said expansive matter in said expansion body is produced by phase transforming of solid phase-liquid phase or liquid phase-gas phase of said expansive matter; a sealing element is mounted between said converter of said volume expansion-displacement expansion and said metal shell, wherein said sealing element is selected from the group consisting of a sealing O ring, a sealing pad, and an annular sealing sleeve;

wherein said separating membrane is metallic or made of high polymer material, for receiving an expansion force produced by said expansive matter to motive said ejector rod piston and said fluid medium is for converting said volume expansion of phase transforming of said expansive matter into the expansion force and displacement transmitted into said ejector rod piston, in such a manner that, when said heater is powered on, said expansive matter expands to produce a volume-displacement change to motivate said force transmitting mechanism, and that said force transmitting mechanism drives the circuit breaker's switch mechanism to open/close a circuit breaker.

2. A driving device of a circuit breaker closing/opening actuating mechanism, comprising:

a heater, a metal shell, an expansive matter positioned inside an inner sealed chamber of said metal shell, and a converter of volume expansion-displacement expansion, wherein said converter of volume expansion-displacement expansion comprises an ejector rod piston, wherein said metal shell has an ejector rod through hole provided on a top surface thereof; said ejector rod piston is movably mounted inside said ejector rod through hole; said ejector rod piston is sealedly connected with said metal shell; a portion of said ejector rod piston positioned inside said inner sealed chamber of said metal shell is connected with said expansive matter directly or indirectly; a mixture of a fluid medium and said expansive matter is positioned inside said inner sealed chamber of said metal shell; said portion of said ejector rod piston positioned inside said inner sealed chamber of said metal shell is positioned in said fluid medium; and a separating membrane is positioned in said inner sealed chamber of said metal shell, and provided between said fluid medium and said expansive matter;

wherein said separating membrane is metallic or made of high polymer material, for receiving an expansion force produced by said expansive matter to motive said ejector rod piston; and said fluid medium is for converting said volume expansion of phase transforming of said expansive matter into an expansion force and displacement transmitted into said ejector rod piston, in such a manner that, when said heater is powered on, said expansive matter expands to produce a volume-displacement change to motivate said force transmitting mechanism, for opening/closing a circuit breaker;

wherein said volume expansion of said expansive matter in said expansion body is produced by phase transforming of solid phase-liquid phase or liquid phase-gas phase of said expansive matter;

wherein a sealing element is mounted between said ejector rod piston and said metal shell, said sealing element is selected from the group consisting of a sealing O ring, a sealing pad, and an annular sealing sleeve;

wherein said heater is positioned in said expansive matter inside said metal shell, or outside said metal shell contacting with said expansive matter; and wherein said expansive matter is paraffin; and said heater adopts a positive temperature coefficient (PTC) thermistor for avoiding overheating, or an electric heating element.

* * * * *